United States Patent [19]

Pollock

[11] 4,434,112

[45] Feb. 28, 1984

[54] HEAT TRANSFER SURFACE WITH INCREASED LIQUID TO AIR EVAPORATIVE HEAT EXCHANGE

[75] Inventor: John J. Pollock, Waynesboro, Pa.

[73] Assignee: Frick Company, Waynesboro, Pa.

[21] Appl. No.: 437,409

[22] Filed: Oct. 28, 1982

Related U.S. Application Data

[63] Continuation-in-part of Ser. No. 308,967, Oct. 6, 1981, abandoned.

[51] Int. Cl.[3] ..... B01F 3/04

[52] U.S. Cl. ..... 261/153; 62/305; 165/170; 165/177; 165/DIG. 13

[58] Field of Search ..... 261/153, 156; 165/170, 165/177, 172, DIG. 13; 62/305

[56] References Cited

U.S. PATENT DOCUMENTS

| | | | |
|---|---|---|---|
| 6,929 | 12/1849 | Du Trembley . | |
| 1,501,646 | 7/1924 | Brown | 165/78 |
| 1,657,704 | 1/1928 | Wescott . | |
| 1,726,458 | 8/1929 | Tellander | 165/170 |
| 2,051,277 | 8/1936 | Stevens . | |
| 2,057,298 | 10/1936 | Feldmeier | 165/170 |
| 2,060,211 | 11/1936 | Hemphill . | |
| 2,911,199 | 11/1959 | Huet . | |
| 2,926,003 | 2/1960 | Pulsifer | 165/170 |
| 3,146,609 | 9/1964 | Engalitcheff, Jr. . | |
| 3,366,172 | 1/1968 | Doroszlai | 165/172 |
| 3,964,873 | 6/1976 | Aramaki et al. | 165/178 |
| 4,002,200 | 1/1977 | Raskin . | |
| 4,196,157 | 4/1980 | Schinner | 62/305 |
| 4,235,281 | 11/1980 | Fitch et al. . | |
| 4,237,970 | 12/1980 | Vehara et al. . | |
| 4,314,605 | 2/1982 | Sumitomo et al. | 165/170 |

FOREIGN PATENT DOCUMENTS

| | | | |
|---|---|---|---|
| 580387 | 7/1959 | Canada | 165/170 |
| 807796 | 1/1937 | France | 165/172 |
| 59703 | 8/1938 | Norway . | |

*Primary Examiner*—Tim R. Miles

*Attorney, Agent, or Firm*—Dowell & Dowell

[57] ABSTRACT

A counterflow evaporative heat exchanger employs parallel vertical uninterrupted coil containing sections having the sides thereof arranged to increase the area of liquid contact within the tubes, the smooth flow of a liquid film on the outside of the tubes, and to increase the impingement of gases against the outsides of the tubes thereby providing smooth liquid flow the full vertical length of each section and permitting the use of maximum air velocity with turbulence but with a minimum of liquid entrainment in the gas stream, thereby enhancing cooling of the internal liquid and reducing the space required for the coil assembly.

6 Claims, 5 Drawing Figures

HEAT TRANSFER SURFACE WITH INCREASED LIQUID TO AIR EVAPORATIVE HEAT EXCHANGE

This application is a continuation-in-part of application Ser No. 06/308,976, filed Oct. 6, 1981 and now abandoned.

TECHNICAL FIELD

This invention relates to heat exchangers and more particularly to the cooling for condensation purposes of a fluid such as a refrigerant in a refrigeration system.

BACKGROUND ART

Various forms of devices for cooling and thereby condensing refrigerants have been known for many years. One of these has been a serpentine cylindrical tube in which a cooling fluid passes transversely across the spaced lengths of the tube, as disclosed in Engalitcheff U.S. Pat. No. 3,146,609, and Doroszlai No. 3,366,172.

Other various arrangements for heat exchange in which attempts have been made to increase the surface available for heat transfer within a given space are illustrated in other patents including Wescott U.S. Pat. Nos. 1,657,704, Stevens 2,051,277, Hemphill 2,060,211, Huet 2,911,199, Raskin 4,002,200, Fitch 4,235,281, and Uehara et al. 4,237,970.

The use of tubes in various shapes for heating or cooling is known in other patents including Aramaki et al. Nos. 3,964,872, Sumitomo et al. 4,314,605, Brown 1,501,646, DuTrembley 6,929, and the French patent to Green 807,796 of 1936.

Closed plate sections have been used in metal radiators as for example in Tellander U.S. Pat. Nos. 1,726,458, Pulsifer 2,926,003, and the Canadian patent to Adams 580,387 of 1959.

Feldmeier 2,057,298 discloses a milk cooler, not an evaporative cooler, having spaced tubes in closed parallel sections, the tiers of which are hinged together.

Schinner U.S. Pat. No. 4,196,157 discloses a coil assembly with tube segments that are spaced apart by more than one tube diameter but not substantially more than two diameters, Schinner stating that the velocity of the air between the tubes varies from 400 feet (122 meters) per minute, but less than 1,400 feet (427 meters) per minute. Schinner attempts to select a velocity at which the downwardly flowing water is not scrubbed from the tube surfaces. However, in Schinner the water drops downwardly through spaces through which the air flows so that substantial entrainment of liquid with air results.

SUMMARY OF THE INVENTION

The present invention is embodied in a counterflow evaporative heat exchanger with parallel, vertical closed coil sections in which the tubes provide a greater area of tube surface thereby increasing the area of liquid contact and the resulting opportunity for heat transfer and in which the spacing between parallel sections is substantially uniform and provides an airflow that constantly changes direction so that the water film thickness on the outside of the tubes and along the connecting portions of the sections produces an enhancing cooling effect.

Accordingly, it is an object of the present invention to provide a tube shape and serpentine tube arrangement which enhances heat transfer both internally and externally of the tubes.

A further object of the invention is to provide an evaporative condenser tube shape which enhances heat transfer.

DESCRIPTION OF THE PREFERRED EMBODIMENT

Figure 1:
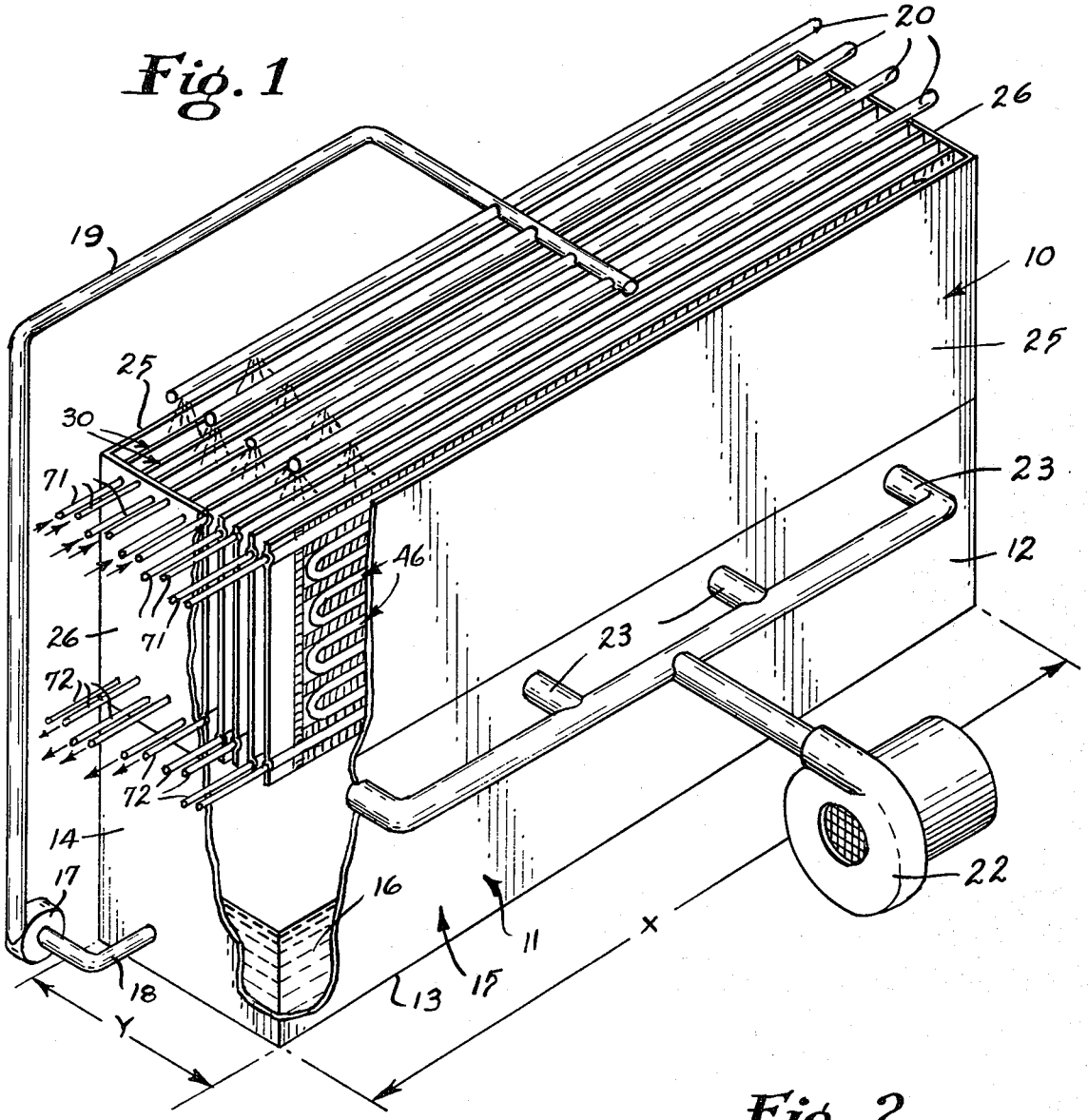
FIG. 1 is a perspective view of a condenser assembly employing the present invention with portions broken away for clarity.

With continued reference to the drawings a typical condenser type heat exchange apparatus has an upper section 10 and a lower section 11 which may be separable. The lower section has spaced generally parallel side walls 12, a bottom wall 13 and spaced generally parallel end walls 14 providing a housing 15 for coolant such as water 16 which is moved by pump 17 through pipes 18 and 19 to one or more headers 20 from which it flows downwardly through conventional outlet nozzles (not shown) through the upper section 10. At the same time, air is moved by a fan 22 through inlet pipes 23 which extend through one of the side walls 12 of the lower section 11 and is discharged upwardly through the upper section 10 in counterflow relationship with the flow of the coolant 16, such air being impelled at a selected flow rate.

The upper section 10 has generally parallel side walls 25 and end walls 26 for providing a housing for the condensing apparatus and for the passage of fluids.

Figure 3:
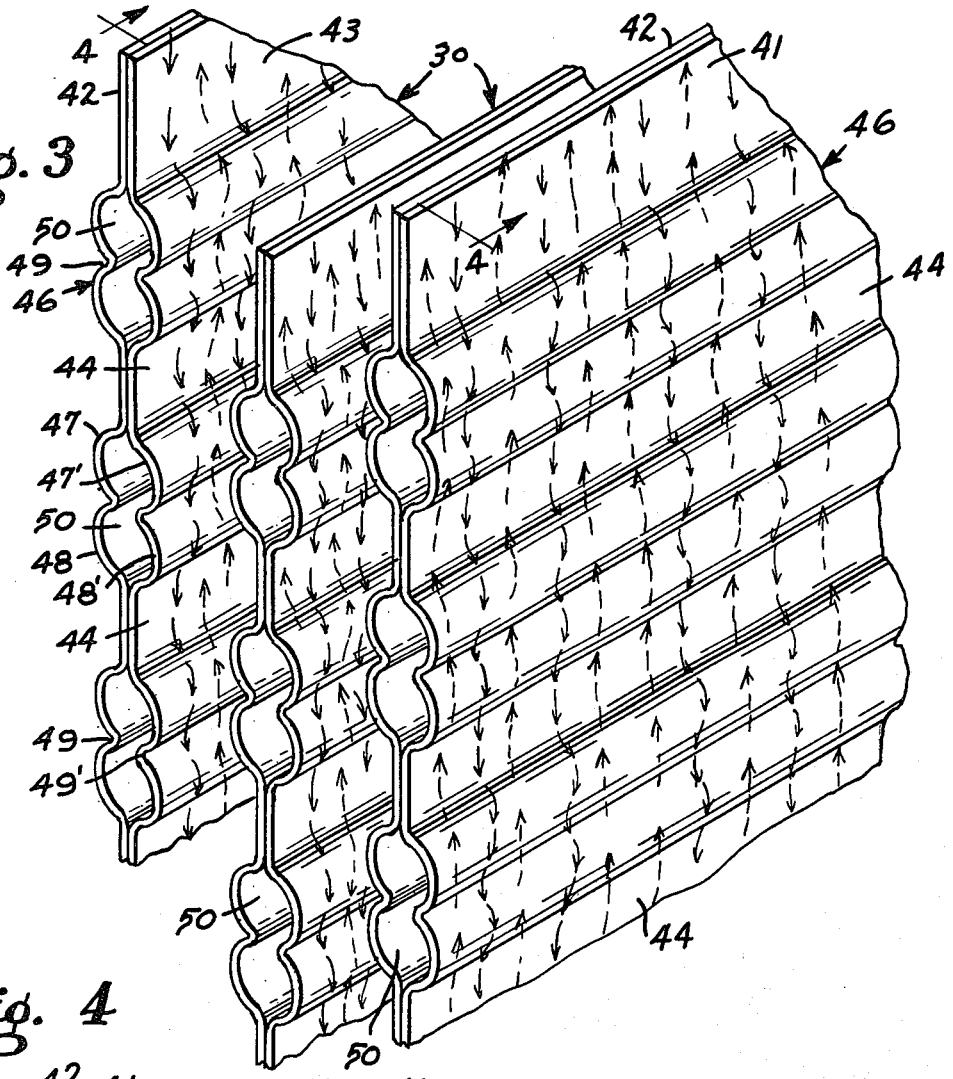
FIG. 3 is an enlarged fragmentary perspective view of several tube sections in cooperative relationship with each other in use.
Figure 4:
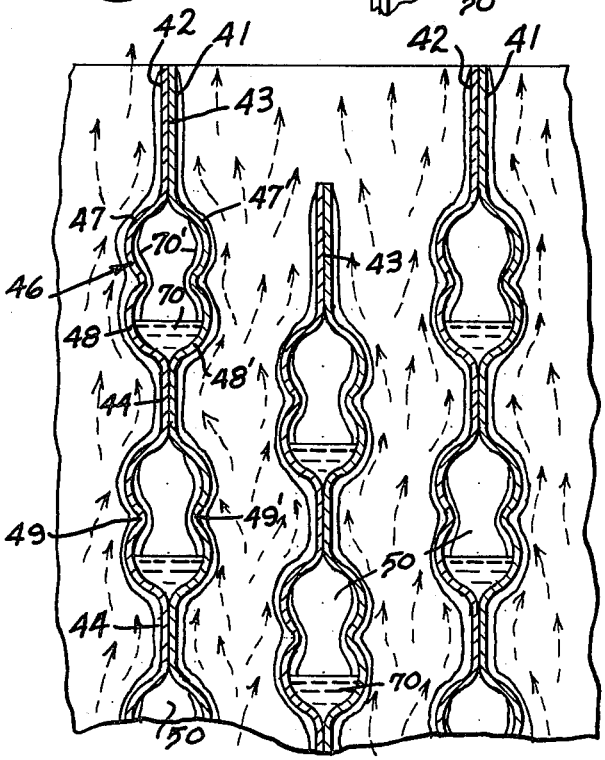
FIG. 4 is a sectional view taken on the line 4—4 of FIG. 3.

The fluid conveying condensing apparatus which is mounted in the upper section 10 is illustrated in its preferred form. Such apparatus includes a bank or assembly of spaced serpentine tube sections 30 which are similar in structure to each other and are arranged in parallel staggered relationship as indicated in FIGS. 1, 3 and 4.

Each tube section comprises a pair of generally rectangular metal plates or sheets 41 and 42 which are welded face to face along their outer periphery 43 and along horizontally extended weld lines or webs 44 spaced from one another at regular intervals along the vertical axis.

In describing the tube sections, the apparatus is viewed as having a horizontal axis "X" along the lines of the sheets as indicated in FIG. 1, a horizontal "Y" axis perpendicular thereto, and a vertical axis.

Intermediate the weld lines 44 the plate portions have been expanded to form parallel tubes 46 spaced from one another. Each tube has substantially circular upper and lower opposing portions 47, 47', and 48, 48' and a reduced diameter central portion 49, 49', such cross section resembling the natural longitudinal cross section of a peanut shell.

The tubes 46 provide a plurality of horizontal condensing passages 50 having a vertical undulating or rippled surface.

Thus, each passage 50 is defined by the inner surfaces of the two opposing upper portions 47, 47', the two opposing lower portions 48, 48', and the two opposing portions 49, 49' of the reduced central section.

The tube sections are separated from one another at regularly spaced intervals along the horizontal "Y" axis as indicated in FIGS. 1, 3 and 4. The tube sections are also alternatively offset from adjacent tube sections as indicated in FIG. 4 so that the tube 46 of adjacent tube sections are in staggered relationship with each other and the reduced central portions 49, 49' of a tube section are approximately opposite the welded portion 44 of an adjacent tube section.

Figure 2:
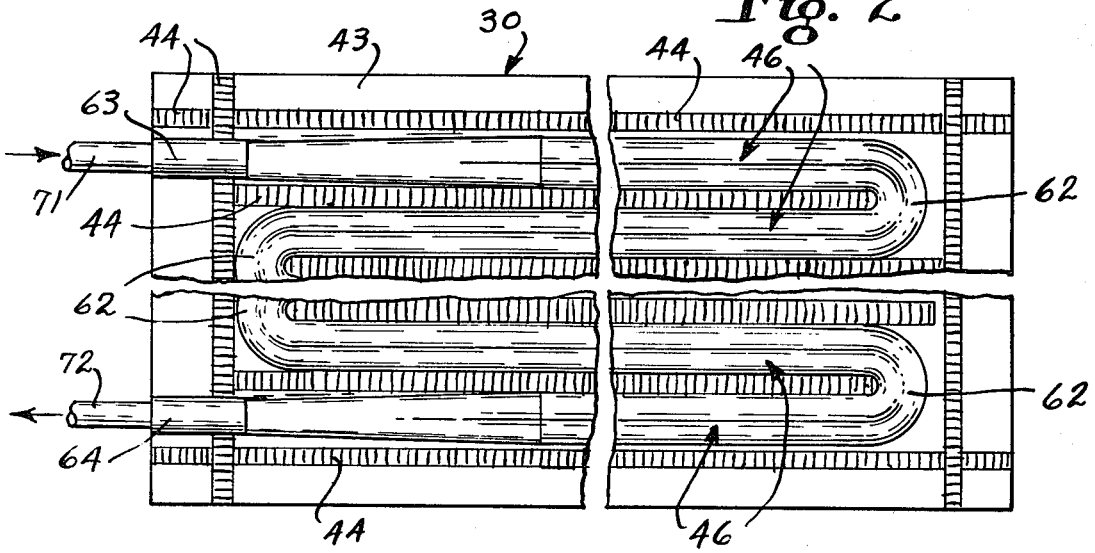
FIG. 2 is an enlarged fragmentary side elevational view illustrating a tube arrangement.

At the ends of each of the tube portions 46, "U" shaped connecting or flow reversal portions 62 are formed to connect the tube portions in serpentine manner, as indicated in FIG. 2. The inlet and outlet ends of the tube 63 and 64 are formed with transition sections of circular cross section as indicated in FIG. 2.

With particular reference to FIG. 4, it has been found that a preferred proportioning and arangement of the tubes and plates sections is similar to that indicated. In one embodiment using 18 gauge meetal (0.049 inch, 1.25 mm) the maximum horizontal distance across the exterior of the upper and lower portions of 47, 47', or 48, 48' of the tubes is approximately 0.52 inch (13.2 mm). The interior distance is therefore approximately 0.42 inch (10.7 mm). The horizontal dimension across the interior of the two portions of reduced width is approximately 0.22 inch (5.5 mm). The maximum horizontal width of the tubes is preferably in the range of 50% to 70% of their height.

The center to center vertical distance between tubes is approximately 1.48 inches (3.76 cm), and the height of the web between tubes is approximately 25% thereof, or 0.375 inch (0.95 mm).

The horizontal distance center to center distance between webs of adjacent sections is approximately 1.0 inch (2.54 cm). While the space between adjacent tube sections narrows slightly where the lower portion of one tube section is partially opposite the upper portion of another tube section the spacing is fairly uniform. The distance between tube sections transverse to the direction of airflow varies between 95% to 105% of the dimension across the portions 47, 47', or 48, 48'. Accordingly, the velocity changer of the air moving upwardly between the plate sections varies only approximately 25%.

In the operation of the device, coolant air enters through the pipes 23 beneath the array of plates and passes upwardly therealong. At the same time, coolant water enters through the header 20 and runs downwardly over the array of plates, thereby providing water to air direct contact in counterflow relationship with each other to induce indirect evaporative cooling of the process fluids such as refrigerant 70 within the tubes.

The inlets 63 may be connected by inlet pipes 71 to a source of fluid to be condensed and the outlets 64 may be connected to outlet pipes 72 which convey the condensed refrigerant to the next stage in the refrigeration system.

The tube sections are spaced apart along the "Y" axis in such a way as to provide the entering air with a velocity level over the plates that accomplishes the optimum heat transfer in cooperation with the gravity flow water stream, if evaporative cooling is used. The object is to minimize the nonwetted plate surface and air pressure loss and at the same time, optimize the resultant of heat and mass transfer within the two phase fluid flow stream.

The undulating surface countour of the heat exchange plates combines with the closely spaced vertically staggered arrangement produces, at the selected flow rate, a turbulent air stream which increases the effective air to water contact for maximum evaporation. Further, the turbulent air in its upward zigzag flow direction impinges against the external surfaces of both the lower and upper regions 48 and 47 of each of the peanut shaped tubes, thereby increasing the overall cooling effect. This dual impingement also retards the downward flow of water over the tubes thus increasing the time available for heat transfer to the water film. This is of particular importance at the upper portion of the tube where a thin liquid film is initially formed as the gas passing through the tube is desuperheated and condensed, and which then drains into the lower portion of the tube. Such impingement thereby promotes vaporization of the water and its movement by the air stream. The resulting improved evaporative cooling enhances the cooling capacity of the apparatus by increasing the rate of heat removal from the refrigerant.

In a typical example it has been found that using a face velocity of 1,000 feet (305 meters) per minute that the upward velocity between the plates averages approximately 1,750 feet (533 meters) to 2,400 feet (732 meters) per minute. In view of the size, configuration and spacing of the tubes in each section there is a smooth flow of water, with substantially no splashing, downwardly over the tubes and the connecting plate portions. This permits the use of a relatively high air velocity of the order stated, of turbulent nature, with a minimum of water entrainment in the leaving air stream. As a result, the cooling capacity is increased so that the space requirements are substantially less than with conventional tube structure.

Figure 5:
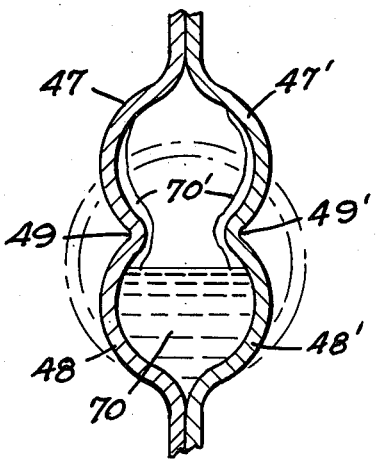
FIG. 5 is an enlarged sectional view illustrating the liquid level in a tube of the present invention as compared to a tube having a circular cross section.

As shown best in FIG. 5, a tube 46 having a configuration in accordance with the present invention has substantially more surface area exposed to the upward flow of air than a conventional cylindrical tube would have. For example, only the lower half of a cylindrical tube is exposed to the upward flow of air while the lower portion and most of the side portions of the tube 46 are exposed to such upward flow, particularly when the air impinges on a tube of one tube section and then is diverted across the channel between tube sections to impinge on a curved area of a contiguous tube section. Additionally, the condensate within the tube 46 will be in heat exchange relationship with a greater surface area than the condensate in a conventional tube having a cylindrical cross section.

The compartmental feature of the tube passages not only improves the cooling characteristics but also improves the structural strength of the tube assembly.

During operation, relatively high velocity process (generally refrigerant) gas enters the top run of the tube 46 and gives up superheat to the plate walls of the upper tube portions 47 and 47' and lower tube portions 48 and 48', the fluid attaining a saturated vapor state. The compartmental feature of the peanut shaped passage 50 then causes the vapor velocity in the upper tube portions 47 and 47' to be maintained at a high level in the presence of a controlled thin liquid film 70' therewithin which drains into the lower tube portions 48 and 48' where the accumulated condensed liquid moves at a moderate velocity.

As a result of the configuration, arrangement of the tubes and the uninterrupted nature of the tube sections the water flow produces a substantially uniform film over the tubes and the plate sections therebetween. Furthermore, the arrangement and spacing and the uninterrupted sections assure water and airflow continuity between adjacent sections. In addition due to the continuous nature of the tube sections there is a reduction in dynamic loss of head of the air and a substantial reduction in the entrainment of liquid carried by the air out of the unit. The particular configuration of the tubes substantially increases the heat transfer capability of the tubes both internally and externally as compared with a tube of cylindrical shape.

I claim:

1. A condenser tube assembly, comprising a plurality of spaced substantially vertical, parallel tube sections, each tube section including a pair of plates connected together along their outer periphery and along spaced horizontal bands within said periphery, facing portions of said plates intermediate said bands being expanded to form parallel tube portions, and connecting portions at alternate ends of said tube portions connecting said tubes in serpentine fashion to provide a unitary tube, the opposite ends of said tubes having free end portions for connection to a source of fluid to be condensed and for discharge of the condensed fluid, respectively, each of said tubes having upper and lower concave facing portions connected by facing portions spaced relatively closer together, said sections being arranged side by side so that the spaced connected horizontal bands of alternate sections are substantially directly opposite in a horizontal plane to the facing portions spaced relatively closer together of each of said tubes, means for introducing a liquid coolant onto the upper portions of said condenser assembly so that said coolant flows down each tube section by gravity in heat exchange relationship with the fluid to be condensed, and means for introducing a flow of air into said condenser assembly and causing said air to flow upwardly between said tube sections and impinge upon said facing portions.

2. A condenser tube assembly, comprising a plurality of spaced substantially vertical, parallel sections, each section including parallel horizontal tubes connected in spaced relation and in serpentine fashion, continuous plate means connecting the tubes, the upper and lower tubes having free end portions for connection to a source of fluid to be condensed and for discharge of the condensed fluid, respectively, each of said tubes having upper and lower concave facing portions connected by facing portions spaced relatively closer together, and said sections being arranged side by side so that the plate means between the parallel tubes of alternate sections are substantially directly opposite in a horizontal plane to the facing portions spaced relatively closer together of each of said tubes, means for introducing a liquid coolant onto said tube assembly and causing said coolant to flow in heat exchange relationship with said tubes and the fluid to be condensed, and means for introducing a flow of air onto said condenser assembly and causing said air to flow upwardly in intimate engagement with said tubes and the liquid coolant.

3. The invention of claim 2 in which each section comprises a pair of sheets of deformable material, each of said sheets having an elongated imperforate channel arranged in a serpentine path with opposite ends of said channel extending adjacent to the edge of said sheet substantially the entire length of each channel, including a pair of spaced first portions remote from the plane of said sheet and an intermediate second portion connecting said first portions and being located closer to the plane of said sheet than said first portions, said channel of one sheet extending outwardly from the plane of the sheet in a direction opposite the channel of the other sheet, and means for attaching said sheets together in facing relationship so that said channels cooperate with each other to form elongated tubes through which fluid may pass freely.

4. The invention of claim 2 in which the distance between each of the upper and lower concave facing portions is approximately 50% to 70% of the height of each tube, in which the height of the plate means between contiguous parallel tubes is approximately 25% of the vertical distance between the centers of the tubes and in which the distance between adjacent sections transverse to the direction of airflow is approximately 95% to 105% of the maximum width of the concave facing portions of each tube.

5. The invention of claim 6, and blower means of a size capable of causing the air to blow upwardly between said sections at a velocity averaging from 1,750 feet (533 meters) to 2,400 feet (732 meters) per minute.

6. An evaporative counterflow heat exchanger comprising a conduit of generally uniform cross section extending in a vertical direction, a coil assembly positioned inside said conduit, said coil assembly comprising inlet and outlet means and a plurality of tubes connected between the inlet and outlet means with different segments of the tubes extending generally horizontally across the conduit in equally spaced relation to each other at different levels in the conduit, the vertically arranged segments of the tubes being continuously connected by imperforate plate means, said sections being arranged side by side so that the plate means between the parallel tubes of alternate sections are substantially directly opposite in a horizontal plane to the tubes in the adjacent section, the tubes in each section having upper and lower concave portions connected by portions of reduced width, liquid distribution means arranged in said conduit above said coil assembly to distribute liquid down through said conduit and over said coil assembly, fan means arranged to move gas upward through said conduit between said tube segments in counterflow relationship to said liquid, the arrangement, size, spacing, and configuration of the tubes and plate means permitting the use of air velocity with turbulence and with a minimum of water entrainment in the leaving gas stream.

* * * * *